United States Patent [19]

Crump

[11] 4,320,917

[45] Mar. 23, 1982

[54] EQUIPMENT CARRYING AND, OR, SECURING DEVICE

[76] Inventor: John M. Crump, 1018 Parkridge Cir. W., Jacksonville, Fla. 32211

[21] Appl. No.: 176,787

[22] Filed: Aug. 11, 1980

[51] Int. Cl.[3] ..... A45F 5/10

[52] U.S. Cl. ..... 294/147; 294/163; 294/165

[58] Field of Search ..... 224/45 P, 45 Q, 45 S, 224/45 R, 50, 917; 12/120.5; 294/147, 163, 165

[56] References Cited

U.S. PATENT DOCUMENTS

| | | | |
|---|---|---|---|
| 2,956,813 | 10/1960 | Madden | 224/45 S |
| 3,209,970 | 10/1965 | Canell | 224/917 X |
| 3,210,787 | 10/1965 | Allsop | 12/120.5 |
| 3,248,027 | 4/1966 | Pfleider | 224/45 S |
| 3,260,430 | 7/1966 | Sandenburgh | 224/45 S |
| 3,272,413 | 9/1966 | Pfleider | 224/45 S |
| 3,718,242 | 2/1973 | Larson | 224/45 S |
| 3,909,718 | 9/1975 | Allsop et al. | 224/45 S |
| 3,990,655 | 11/1979 | Covell | 224/45 S |
| 4,190,182 | 2/1980 | Hickey | 224/45 S |

*Primary Examiner*—Steven M. Pollard

[57] ABSTRACT

The invention is a device for assembling, transporting, displaying, packaging, carrying and, or, securing any desired combination of equipment such as skis, poles and boots. The device includes oppositely disposed equipment retainer means symmetrically related and movably mounted in a mutually aligned relationship relative to a base member. Said retainer means being selectively adjustable to allow any desired combination of said equipment, or the like, to be retained therewith. Manipulatable securing means is provided such that the said retainer means may be adjusted to accommodate various equipment sizes and also to provide a method whereby the consequential assembling of any combination of said equipment causes said equipment to be releasably secured therewith and further providing means incorporated into the same device for locking said device with a cable type security lock, or the like.

14 Claims, 10 Drawing Figures

EQUIPMENT CARRYING AND, OR, SECURING DEVICE

TECHNICAL FIELD

The present invention relates to a device for carrying, storage, transporting, assembling, packaging, displaying and, or, securing any combination of equipment such as skis, poles and boots, or the like, while simultaneously providing a method of assembling such equipment in a single, integral means for securing the complete device and any combination of equipment retained therewith when a skier leaves the equipment unattended in a ski resort, public area, or any place where convenience and security are desired for such equipment.

BACKGROUND ART

The prior art, U.S. Pat. No. 3,210,787 provides for boot carrying only. U.S. Pat. No. 3,990,655 provides for ski and pole carrying and securing. Each of these devices is limited to their independent uses.

This applicant has disclosed other embodiments of the present invention in application Ser. No. 057,306 dated July 13, 1979, 125,340 dated Feb. 28, 1980, and 128,673 dated Mar. 10, 1980.

DISCLOSURE OF INVENTION

In accordance with the present invention, I provide a method of assembling skis, poles and boots, or the like, into a single, integral device having cooperable members for carrying and, or, securing any desired combination of equipment such as skis, boots and poles. The device includes a pair of mutually aligned oppositely disposed and symmetrically related cooperable retainers, each selectively movable on a centrally located column member, one of the retainers being adapted to cooperate with a base portion and the boots to form a pair of ski and pole magazine retention chambers. The device consisting of a unitary mechanism having relatively symmetrically configured movable parts that may be selectively manipulated into variable positions to receive boots, skis and poles into releasable securement therewith and which may be locked in their enclosed or retaining positions.

My improved carrying and securing device provides a novel method of assembling and the advantage that the cooperable parts are adjustable and selectively manipulatable by means disposed at the top of a base column member thereby allowing the device to not only be utilized to accomodate the full range of equipment sizes but to also be retracted to a minimum height when the device is utilized for carrying and, or, securing skis and poles without boots.

The single adjustable securing and locking means located at top of a base column is common to all adjustment and utilization features inherent in this invention such that the device is positively secured in a selected equipment retention position. This feature is of particular advantage since it provides in one single device the capability and methods of carrying and, or, securing any desired combination of skis, poles and boots. Other objects and advantages reside in certain novel features of the method of assembly, arrangement and combination of parts which will be hereinafter more fully described and particularly pointed out in the appended claims, reference being made to the accompanying drawings forming a part of this specification.

BRIEF DESCRIPTION OF DRAWINGS

The details, features and principles of my invention, as well as further objects and advantages will be more fully understood by reference to the accompanying drawings and following detailed description, which disclose, by way of example the presently preferred but none the less illustrative embodiment in accordance with the mode contemplated of applying that principle, in which.

BEST MODE FOR CARRYING OUT THE INVENTION

Figure 1:
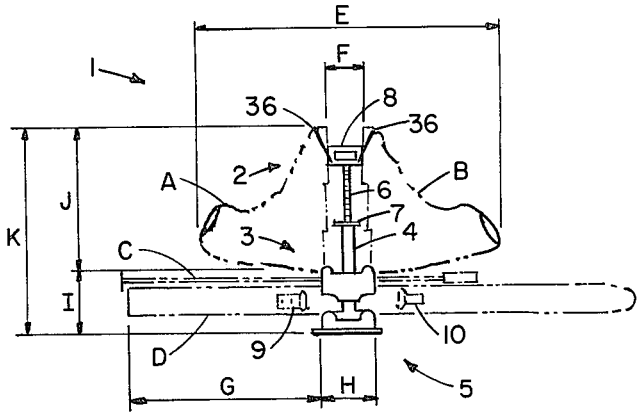
FIG. 1 is a view in side elevation illustrating the method of assembling a class of equipment embodying the present invention.

Referring now specifically to the drawings and first to FIG. 1, there is shown and illustrated a method of assemblage embodying features and principles of the present invention, generally designated by the reference numeral 1, which includes a pair of boots A and B together with a pair of skis D and their accompanying poles C secured into the illustrated assemblage by means of a centrally disposed device comprising a pair of mutually aligned, selectively manipulatable, and cooperative boot retainer units 2 and 3 each slidable or movably mounted to a base column 4 which in cooperation with base member 5, handle column 6, securing means 7 and hand grasp 8 provide a means for selectively carrying and, or, securing any combination of boots, skis and poles. Skis D are confined longitudinally within base 5 by ski bindings 9 and 10. FIG. 1 illustrates an assemblage of equipment having a characteristic longitudinal side profile with dimensions E, F, G and H and compact vertical dimensions I, J and K. Observe that when boots A and B are not secured therewith dimension J becomes substantially zero thus causing dimension K to approach dimension I. When skis D and poles C are not secured therewith dimension K approaches dimension J. Dimension F may be selected in cooperation with securing means 7 dimensions in order to achieve adequate operational freedom together with hand grasp comfort.

Figure 2:
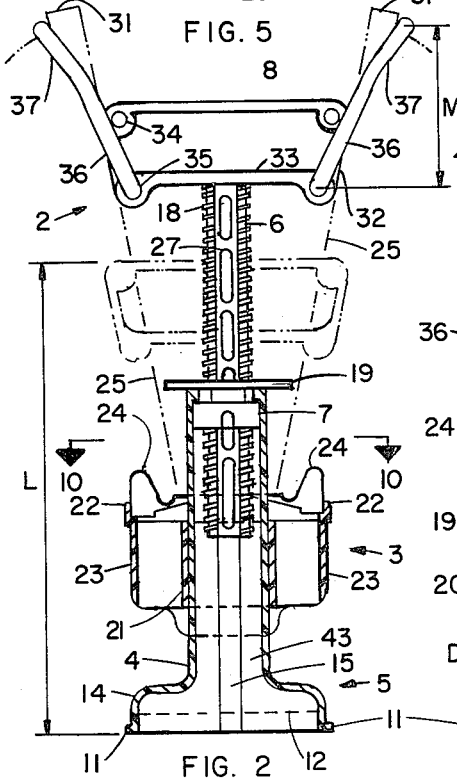
FIG. 2 is a partial cross sectional perspective view, illustrating the device in extended position as at the beginning of an equipment assembling operation or conclusion of an equipment removal operation.
Figure 3:
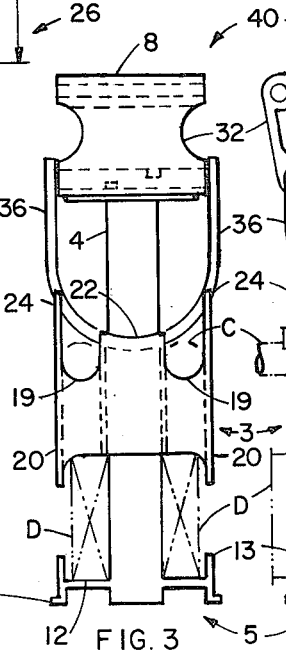
FIG. 3 is an end view illustrating the device with skis and poles.
Figure 4:
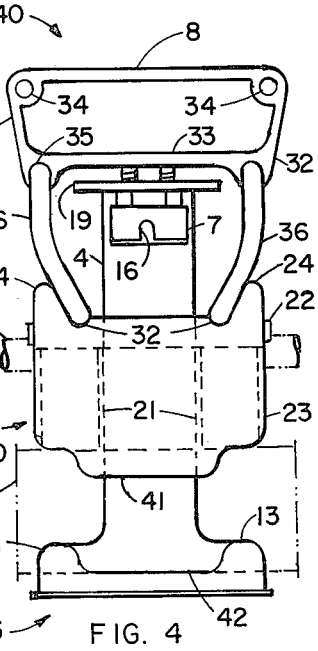
FIG. 4 is a side view illustrating the device with skis and poles.

The broad theory of the carrying and, or, securing principles of this invention are further disclosed in FIGS. 2, 3 and 4 wherein the base member 5 is shown as being generally rectangular in shape or configuration including arcuate flanges 11 and portions thereof at different levels to form the lower part of a pair of oppositely disposed ski chambers having substantially flat ski support bases 12, upstanding longitudinally extending side walls 13 and centrally disposed upstanding base column member 4. End walls 14 extend longitudinally from base column 4 providing interior side walls for ski chambers and structural reinforcing for base member 5 and column 4. Each of the side walls 13 has a central recess section 15 the bottom edge of which is coplanar with the top surface of ski support bases 12 and generally shaped to cooperate with lower boot, ski and pole retainer unit 3. Base column 4 has two oppositely disposed torsional guide splines 15 for guiding and torsional control of handle column 6 and for cooperation with securing means 7. The upper portion of column 4 is configured for assembling and functional cooperation with securing means 7. Base column member 4 has a central cavity extending downwardly thus providing a receiving opening 18 for adjustable handle column 6. FIG. 2 illustrates, among other things, the synergistic characteristics of base column member 4 as it cooperates with the selectively manipulatable parts 3, 6 and 7.

Lower boot, ski and pole retainer unit 3 comprised of two symetrically disposed longitudinally extending pole chambers 19 with upward and downwardly depending side walls 20 having transverse structures 21 bridging therebetween and cooperating with base member 5 and column 4 to form ski and pole securing means. Unit 3 generally rectangular and conforming substantially to the plan configuration of base member 5. However, for simplicity of description Unit 3 and its side walls 20 are shown having a substantially open top structure bridging therebetween with symetrically disposed upstanding boot retention lips 22 generally perpendicular to axis of pole chambers 19 and integral with end walls 23 which in turn comprises part of the ski retention means. Lips 22 extend in a congruous manner and together with side retention lips 24 facilitate holding of boots and also reinforce the structural unit 3. The pole chambers 19 may be provided with reinforcing ribs (not shown) to aid in lending rigidity to the structure and providing snap-in releasable pole holding features. In a similar manner, the side walls 20 may be provided with reinforcing ribs for added strength and structural rigidity. Structural members 21 form an aperture to conform with exterior configuration of column 4 thus guiding unit 3 vertical motion and restraining against rotational motion.

Slidably mounted within base column 4 is handle column 6 having a plurality of apertures 27 adapted to cooperate in conjunction with securing means 7 for adjustment and locking of device 1 in FIG. 1. Symetrically disposed and extending upwardly from handle column 6 are a pair of generally upstanding sloping, substantially, similar, handle hand grasp end abutments 32. Said abutments 32 are disposed transversely to the longitudinal axis of pole chambers 19 and form the end walls of hand grasp 8. The abutments 32 are each formed with a pair of openings 34 and 35 for the purpose of rotatably supporting boot retainers 36 which may be selectively installed in either openings 34 or 35 depending upon length of boots A and B relative to extended length K of device 1 in FIG. 1.

Figure 6:
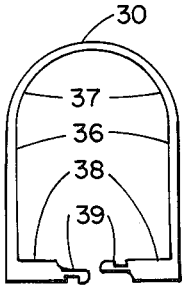
FIG. 6 is a isolated view of the boot retainer.

With reference to FIG. 6 retainers 36 include side members 37 and rotation support shaft 38 and may be formed for key-in type fastening 39 to abutments 32. Thus once the retainer shafts 38 are inserted into openings 34 or 35, and their keys 39 locked the retainers 36 are free to rotate but cannot be removed from the openings since there is no access to unsnap the keys 39. The exterior flat surface of abutments 32 are sloped to cooperate with boots A and B relative to lower boot retention lips 22. Integral with abutments 32 and bridging therebetween is a substantially flat hand grasp structure 33.

Figure 9:
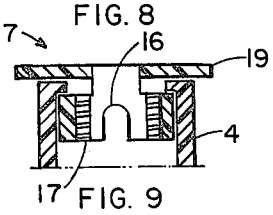
FIG. 9 is a partial sectional view taken on line 9—9 of FIG. 7.

As best seen in FIGS. 2 and 4, the securing means 7 is movably and detachable engaged to portions of base column 4. Referring to FIGS. 2, 3, 4, 5, 7 and 9 there is shown an illustrated selectively manipulatable securing means 7 cooperating with handle column 6 and base column 4. Securing means 7 is cylindrical or tubular type circumferentially enlarged at its upper end with a plurality of circumferentially located locking apertures 16. The securing means 7 has a relatively short axial length SM with a portion for thread 17 or equivalent, detachable engagement with threads 18 of column 6. Preferably, the finger contact turning surface 19 of means 7 is knurled, roughened or provided with turning ribs in order to facilitate manipulation. In FIG. 4, observe that retainers 36 interface with receiving slots 32 located in upper part of side walls 20. The lower part of side wall 20 has a downwardly extending flange 41 for retaining top edge of skis D. FIG. 9 shows securing means 7 with the handle column 6 removed illustrating the interface configuration between means 7 and base column 4.

Figure 10:
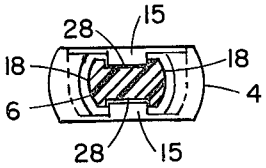
FIG. 10 is a plan view of base column taken on line 10—10 of FIG. 2.

Handle column 6 has been illustrated in FIGS. 9 and 10 as generally rectangular in cross section with threads 18 on partial opposing surfaces and a pair of longitudinal keyways 23 conforming generally to the interior cavity of column 4. It should be noted that the cross sectional configuration of column 6 and column 4 may be any shape consistent with the functional and structural features of the invention. This includes circular members and multiple members to achieve both stability and adjustment. The lower end of column 6 may have a pair of oppositely disposed shear keys (not shown) which in cooperation with a pair of shear key stops (not shown) at the upper interior portion of column 4 will provide means whereby column 6 cannot be accidently fully retracted from column 4.

Turning now to FIGS. 3 and 4 there is shown device 40 with handle column 6 retracted downwardly into base column 4 illustrating the general configuration of the invention when utilized for carrying and, or, securing poles C and skis D without boots A and B. Boot retainers 36 have been rotated downwardly into a position parallel with and rearwardly of sloping abutments 32. Securing means 7 has been manipulated to achieve the mutually cooperative position of parts 3, 4, 6, 7 and 36 thereby providing a device 40 for carrying and, or, securing poles C and skis D. Observe that the cooperable aspects of securing means 7 with columns 4 and 6 together with retainers 36 allow means 7 to normally function in the upper region of column 4 thus achieving more freedom between bottoms of boots soles 25. Observe in FIGS. 2, 4 and 6 that retainers 36 are constructed such that a small amount of yielding may take place during the final compression or biasing of handle column 6 downward to retain equipment therein.

While plastic is considered a suitable material it is understood that the device 40 can be manufactured from a variety of materials including wood, and skeletonizing metal wire forming. Furthermmore, the selection of alternate materials introduces considerations of engineering properties such as shear strength, yield, tensile strength, density, poisson's ratio, fatigue strength, corrosion resistance and other properties which when considered together with the fabrication tooling techniques can have an influence upon members and the exterior appearance of device 40 while at the same time utilizing the novel characteristics of the invention described hereinbefore. Thus, the three main parts 2, 3 and 5 are each preferably formed as unitary members molded from a suitable plastic each cooperating with the other to provide the important features of construction necessary for compactness, simplicity, ruggedness, lightweight and uniquely adapted to engage ski equipment, or the like, utilizing the method of assemblage described herein.

Figure 5:
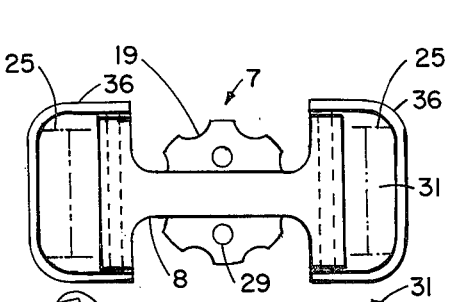
FIG. 5 is a plan view at the hand grasp structure shown in FIG. 2.

FIG. 5 shows a plan view of device 26 illustrating the relationship between hand grasp 8, retainers 36 and securing means 7. FIG. 10 shows the relationship between key ways 28 in handle column 6 and column key splines 15 in base column 4.

OPERATION OF THE INVENTION

Operationally, device 40 of FIG. 4 provides a method whereby a class of equipment such as skis, poles and boots may be carried and, or, secured in an assemblage 1 illustrated in FIG. 1. Therefore, device 40 comprises a pair of mutually aligned, selectively manipulatable equipment retainer units 2 and 3 movable mounted fro cooperating with a base member 5 whereby any combination of boots A and B, poles C and skis D may be assembled therewith and subsequently releasably engaged therewith by manipulation of securing means 7 such that the consequential selective engagement of the cooperable parts thus illustrated causes any desired combination of equipment such as skis D, poles C and boots A and B to be releasable secured with device 26 as illustrated in FIG. 2 or device 40 as illustrated in FIG. 4.

Assuming an initial device 26 posture as shown in FIG. 2 and that it is desired to assemble equipment such as that illustrated in FIG. 1. First, manipulate securing means 7 by counterclockwise rotation about column 4, assuming right hand threads 17 and 18, thereby causing column 6 to move upwardly relative to column 4. Secondly, move lower retention unit 3 upward allowing skis D to be placed onto ski support bases 12 following which retention unit 3 is lowered downward onto top of skis D. Poles C may now be placed into pole chambers 19. Thirdly, raise handle 8 up with one hand while placing heel of boot A onto retainer lips 22 following which upper retainer 36 is placed over the toe of boot A. Fourthly, repeat third step for boot B. Fifthly, apply slight downward force on handle 8 while simultaneously turning means 7 clockwise thereby causing column 6 to move downwardly thus causing the assembled equipment to be releasably secured with device 26. A locking cable, not shown, may now be communicated through apertures 16 thereby locking device 26 against unwanted removal and, or, use when attached to some convenient stationary object. Boots A and B may be assembled with toe up or toe down.

Should the initial posture be without any equipment and it is desired to assemble poles C and skis D without boots A and B, as shown in FIGS. 3 and 4, then it is only necessary to manipulate securing means 7 counterclockwise causing column 6 to move upward on base column 4. Lower retainer unit 3 may now be raised upward about base column 4 causing hand grasp 8 to also move upward thereby providing freedom for installation of poles C into pole chambers 19 which may be constructed for snap-in type retention to facilitate installation of skis D. With unit 3 held in the upward position skis D are installed onto ski support bases 12 following which unit 3 is lowered thereby causing poles C and skis D to be retained within the oppositely disposed and mutually aligned side walls 20 and 21. Securing means 7 may now be manipulated clockwise causing it to move downward thereby causing said equipment to be retained in releasable securement with device 40. A locking cable (not shown) may be communicated through apertures 16 thereby locking device 40.

When boots A and B are to be carried and, or, secured with device 26 of FIG. 2 without poles C and skis D, first manipulate securing means 7 counterclockwise causing column 6 to move upward on column 4. Rotate boot retainers 36 upward. Raise hand grasp 8 upward and install heel of boot A into engagement with boot retention lip 22. Engage boot retainer 36 over boot toe. Repeat the above for boot B. Apply slight downward force upon hand grasp 8 while simultaneously manipulating securing means 7 clockwise until the proper holding force is applied. Boots A and B are now releasably secured with device 26. A locking cable (not shown) may be communicated through aperture 16 thereby locking device 26. The cooperative consequence of the above resulting in a device 26 for carrying and, or, securing any desired combination of equipment such as boots, skis and poles.

Although the assemblage 1 of FIG. 1 has been illustrated and described herein for use in carrying and, or, securing ski equipment, it is evident from a broader standpoint, that the purpose of device 26 is to carry and secure equipment of the nature illustrated whether it be equipment for skiing, hunting, tennis, golf, ice skates, fishing, roller skates, mountain climbing, industrial safety, some form of special tools or some class of special apparatus associated with a particular sport or work speciality which may be domestic or military in application. It should be understood, therefore, that it is not intended to limit the principles of the present invention to ski equipment alone, but rather to equipment according to the utilization principles of the present invention for various other uses, all of which are fully contemplated according to the features of the present invention.

It is instructive to teach certain alternative variations associated with device 26. The preferred embodiment of column members 4 and 6 depends on the details of manufacturing techniques and may be any geometric configuration ranging from circular to rectangular in cross section. The modified rectangular configuration has been illustrated for simplicity since it is obvious that these members are susceptible of change and modifications without departing from the principles, spirit and novel features of the invention. Resilient snap type retention means for poles C may be positioned any where along the longitudinal axis of pole chambers 19. Various reinforcing ribs may be selectively located to achieve appropiate strength characteristics. Resilient urging bands may be located internal to hand grasp 8 thereby providing an optical feature to facilitate equipment installation. Boots A and B of FIG. 1 may be reversed and the heels secured by retainers 36. The infinite adjustability feature of securing means 7 may be achieved by molding threads on column 6 and locating means 7 at the upper terminus of column 4 such that it is free to be rotated but does not move vertically. Column 4 may also be provided with any one of a variety of cam and ratchet type fastening mechanisms for adjusting column 6 up and down. Thus a securing means, of the class illustrated in FIGS. 2, 3, 4 and 7 provided with threaded connections, or other equivalent means for detachably mounting thus allows means 7 to infinitrally adjust column 6 along the vertical axis of column 4. While there are other methods of accomodating a locking cable it should be noted that the method illustrated provides for security since the cable passes not only through the securing means 7 but also the main column structures 4 and 6. Although not illustrated it is obvious that the standard combination type locking cable once attached to device 1 of FIG. 1 may then be attached to any convenient stationary object. Observe in FIG. 2 that oppositely disposed openings 34 and 35 provided in the handle end abutments 32 such that boot retainers 36 may be optionally rotated therefrom. Should this option be utilized it may be seen by inspection of FIG. 3 that the retainers 36 could then be utilized as cooperative members of the securing means by bringing retainers 36 to rest upon the top surface of unit 3. Thus, since means 7 would also be restrained and hence unit 3 would simultaneously be restrained. Also, it is significant to note that device 26 of FIG. 2 may be constructed to carry and, or, secure skis and poles without any provisions for boots A and B. Note in FIG. 2 that the lips 22 of unit 3 may be located substantially at the extreme lower end of column 4 on base 5 thereby converting device 26 to carry and, or, secure boots A and B without any provisions for skis and poles. Securing means 7 can be rotatably secured to top of column 4 and adjustably secured to column 6 with threads such that means 7 move up or down. In FIG. 6 retainer 36 may have a countour 30 conforming to boot toe 31 generally as illustrated in FIG. 2.

Figure 7:
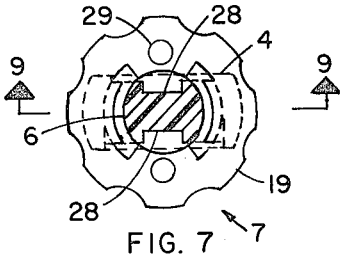
FIG. 7 is a plan view of the adjustable securing means.
Figure 8:
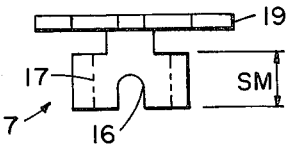
FIG. 8 is a side view of the adjustable securing means.

To achieve optimum combination of dimensions F, H, L, M and SM together with a functionally satisfactory configuration of securing means 7 it is instructive to teach that means 7 can have a dimension SM, shown in FIG. 8 such that the upper most portion extends up thereby causing turning ribs 19 to be located on a turning portion generally just below handle structure 33 which because of dimension F, shown in FIG. 1, provides greater freedom for operating means 7 when boots A and B are assembled therewith. Furthermore, the turning means 19 can be located within the hand grasp structure 33 and provisions for locking located therewith. As illustrated in FIG. 7 multiple apertures 29 may be located in means 7 thereby providing alternate means for inserting a locking cable (not shown).

Among the variations suggested and taught by the illustrations and description and fully contemplated within the scope of this invention is a variety of ratchet and pawl and other shear type quick release mechanism. Working models of these and other variations are being tested and investigated.

Therefore, having disclosed the synthesis and analysis of construction features, including variations thereof, it is understood that the fundamental novel aspects of the invention can be achieved using a variety of substitutions and changes without departing from the spirit of the invention. The broad theory for the equipment carrying, securing and assembling techniques of this improved device 26 have been illustrated, described and pointed out including the fundamental novel features as applied to a preferred embodiment 26 comprised of, symmetrically related and oppositely disposed, mutually aligned parts manipulatively mounted onto a centrally located retractile column members such that the cooperative consequences results in a device for selectively carrying and, or, securing any desired combination of equipment such as boots A, B, skis D and poles C.

According to the principles of the present invention therefore, methods and procedures for assembling any combination of equipment such as skis, poles and boots are provided within the device 1 of FIG. 1. In a single device 26 illustrated in FIG. 2 the means for carrying and or securing any combination of said equipment uniquely retained in assembled interrelated positions, as shown in FIG. 1, ready for transporting, storage, securing and, or, locking, or activities associated with the equipment retained therewith. Furthermore, according to the methods and procedural steps, and more specifically, the device 1 of FIG. 1 may be manipulated to provide all of the above features for skis and poles without boots as illustrated by device 26 of FIG. 2. Still further, from FIGS. 1 and 2 it is seen that boots may be afforded all of the above mentioned features without skis and poles. It follows, therefore, that this new device permits the manufacture of a simpler and less expensive device to achieve more combined functions than has heretofore been known.

All in all, the features of my new and improved carrying and, or, securing device bring forth an advancement in the art over prior known devices and with the utilization of structural components and configuration as described produces a synergistic utility effect resulting in improved life and ruggedness for a device of the character described. It will also be recognized and appreciated that the utility of the unique yet simple mechanism, particularly the parts thereof, eliminates the need for maintenance repairs and or replacement of parts since the structural integrity does not depend upon resilient biasing means. Securing and locking as used in the description hereinbefore refers to the capability of being secured by the owner such that unauthorized removal and, or, use will not be permitted. It also means that the equipment is securely held captive with said device.

The selected modifications herein described for the adaption to a device 26 are set forth for the purpose of completing the disclosure. Depending on the manufacturer and technique used, components molded from a variety of plastics, or other materials, have a good balance of properties and are adaptable to many design requirements. Decisions regarding which technique is best suited for the present invention rest primarily upon materials, economic, reliability and ease of performance.

Therefore, according to the principles of the present invention, a unique and novel equipment carrying and, or, securing device is provided whereby an integrated method of assembling equipment that functions basically as a unit during transporting, storage or other uses. While it has been shown and described as a plurality of modified arrangements in which the invention may be embodied, it is to be understood that these constructions have been selected for the purpose of illustration and that various changes in size, shape and arrangement of the parts may be made without departing from the spirit of the invention or the scope of the subjoined claims. While I have shown and described constructions in which my invention may be embodied, it is to be understood, therefore, that variations in the construction and arrangement may be made without departing from the spirit and scope of the invention as disclosed in the appended claims, in which it is intended to claim all novelty inherent in the invention as broadly as permissible, in view of prior art. This invention further resides in the construction, combination and arrangement of elements illustrated in the accompanying drawings, and while I have shown thereon preferred embodiments, it is to be understood that the same is susceptible to modifications and changes; and comprehends other details, arrangement of elements, features and construction without departing from the spirit of the invention, and that all matters herein set forth or shown in the accompanying drawings are to be interpreted as illustrative and not in the limiting sense. In view of this disclosure, variations and modifications will doubtlessly be generated by others skilled in the art to obtain all, or part of the benefits of this invention without duplicating the framework shown, and I therefore claim all such variations and modifications insofar as they fall within the reasonable spirit and, or, scope of my proposals and claims.

It is the intention, thus, to be limited only as indicated by the scope of the following claims. Accordingly, the scope of the invention should be determined not only by the embodiment illustrated, but by the appended claims and their legal equivalents, and all changes which come within the meaning and range of equivalence of the claims are therefore intended to be embraced therein.

Thus, in addition to the principles of the present invention 1 of FIG. 1, 26 of FIG. 2 and 40 of FIGS. 3 and 4, methods and procedures have been described for assembling ski equipment, or the like, into a uniquely secured interrelated position for merchandizing, carrying and, or, securing any combination of said equipment in a multi-function equipment device 26. According to the principles of the present invention, therefore, an embodiment of the merchandizing, carrying, and, or securing device 26 for fulfillment of the assembly methods and procedures of the present invention is illustrated in FIGS. 1 through 10.

The invention is not limited to the particular preferred and illustrated exemplary embodiments that have been disclosed for graphic illumination. A number of further embodiments exist which are within the scope of the present invention and it will be understood that variations or modifications thereof which are within the scope and spirit of the appended claims are fully contemplated.

Having thus described my invention, I claim as new and desire to secure by Letters Patent:

1. In a device for carrying and/or securing any desired combination of equipment such as skis, poles and boots comprising: oppositely disposed retainer means symmetrically related and movably mounted in a mutually aligned relationship relative to a first and second column member, said retainer means selectively movable by manipulation of a securing means releasably communicating with said first column member and rotatably supported interiorly at the upper terminus of said second column member, one of said retainer means cooperating with a base member and said securing means such that the consequential assembling of any selected combination of equipment such as boots, skis and poles causes said equipment to be releasably secured therewith.

2. In a device as described in claim 1, further comprising: A plurality of apertures in said first column member adapted to cooperate in conjunction with a plurality of locking apertures in said securing means for installation of a locking means, said securing means being removably received for rotation within said second column member having a portion thereof selectively constructed to rotatably cooperate with said second column member in dependence upon the combination of equipment assembled therein.

3. In a device as described in claim 1, wherein said oppositely disposed retainer means consists of at least one pair of movable parts which are selectively engageable with boots when mutually aligned in a predetermined relationship, said parts being keyed to said retainer means to allow rotational movement and prevent unwanted removal except in a selected unique position.

4. In a device as described in claim 1, wherein said first column member embodies a pair of oppositely disposed longitudinal keyways which cooperate with corresponding torsional guide splines disposed longitudinally on said second column member, said first column member further embodying oppositely disposed peripheral portions with adjustable engagement means which cooperate with corresponding adjustable engagement means interiorly of said securing means, said securing means rotatably mounted at a location on said second column member that is stationary with respect to the longitudinal axis of said second column member.

5. In a device for carrying and/or securing any desired combination of equipment such as skis, poles and boots comprising: Oppositely disposed retainer means symmetrically related and moveably mounted in a mutually aligned relationship relative to a threaded handle column and a hollow base column, the handle column being telescopically received within the hollow base column, said base column having an internally threaded adjustable securing means rotatably captured within said hollow base column for manipulating and adjusting said handle column, said adjustable securing means having a finger contact turning means, said retainer means manipulatable one relative to the other for selectively engaging any combination of equipment such as skis, poles and boots into releasable securement therewith.

6. In a device as described in claim 5, wherein said handle column carries retention means comprising one pair of rotatable parts which are selectively engageable with boot toes or boot heels when mutually aligned in a predetermined relationship generally inclined upwardly and optionally rotated to a generally downwardly relationship for cooperation with said oppositely disposed retainer means whereby said skis and poles are releasably secured without said boots.

7. A device of the class illustrated for carrying and/or securing any desired combination of equipment such as skis, poles and boots comprising:

first retention means for releasable engagement with oppositely disposed boot toes;

second retention means for releasable engagement with oppositely disposed boot heels;

means provided with one of said retention means to retain said skis and poles therewith;

first and second column members cooperating with said retention means for supporting and guiding the selective manipulation of said retention means into cooperative engagement with said equipment;

and manipulatable securing means releasably communicating with said first column member and rotatably supported interiorly at the upper terminus of said second column member.

8. In an equipment carrying and/or securing device comprising movable retaining units having oppositely disposed symmetrically related releasable boot, or the like, engaging means, one of said retaining units structured with oppositely disposed downward and upwardly depending side walls adapted to form ski and pole retention chambers, said retaining units movably guided by a central column member cooperating with an adjustable securing means rotatably supported interiorly at the upper terminus of said column member, whereby said retention units may be manipulated one relative to the other for selectively engaging any combination of equipment such as boots, skis and poles into releasable securement therewith.

9. A device of the character described comprising a pair of mutually aligned and selectively manipulatable cooperative retention units, one of said retention units provided with means for retaining skis and poles, each of said retention units having releasable boot engaging means, each of said retention units mounted for guided movement on respective first and second central column members having an adjustable securing means releasable engaged between said column members and rotatably supported interiorly at the upper terminus of said first column member such that the consequential functioning causes said equipment to be releasable secured with said device.

10. A ski equipment assembling, carrying and securing device comprising mutually aligned cooperable parts, boot retention means contained on a first and second of said parts, an adjustable securing means on the first of said parts, said securing means releasably communicating with said first part and rotatably supported interiorly at the upper terminus of said base column member, said parts and said securing means selectively manipulatable whereby both of said parts may be moved one relative to the other for selectively engaging any combination of ski equipment such as boots, skis and poles into releasable securement therewith.

11. In a ski equipment assembling, carrying, displaying, transporting and/or securing device, cooperable units, first of said units having a pair of boot retainers oppositely disposed about a centrally located carrying means, second of said units having a pair of congruous boot retainers disposed symmetrically with respect to a pair of ski and pole retention means movably guided on a centrally located column having a pair of ski support bases at its lower extremity, adjustable securing and locking means cooperating with said units and said column such that said units are selectively adjustable whereby any combination of said boots, skis and poles may be releasable secured therewith, said securing and locking means rotatably supported interiorly at the upper terminus of said column member.

12. In a method of assembling ski equipment and the like with a device for carrying and/or securing said equipment, said equipment being of the type comprising any combination of boots, skis and poles; the steps of:

positioning said skis onto ski support bases after which a ski magazine unit is moved down into releasable retention therewith; positioning poles parallel within releasable pole retention chambers;

inserting said boots into releasable engagement with oppositely disposed boot retention members located generally above and perpendicular to the longitudinal axis of said poles and skis;

and performing an adjustment operation after one or more of the above steps whereby any desired combination of said equipment is retained in releasable securement with said device, said adjustment operation comprises the manipulation of a securing means releasably communicating with a first column member and rotatably supported interiorly at the upper terminus of a second column member.

13. A composite magazine and retainer for carrying and/or securing any combination of equipment such as skis, poles and boots, comprising retractile members selectively movable thereby effectuating the juxtapositioning of said equipment into cooperative assemblage therewith, a manipulatable securing means adjustably communicating wth one of said members and rotatably supported interiorly at the upper terminus of a base column member, the consequential engagement of said members with said equipment thereby causing any desired combination of said equipment to be assembled into releasable securement.

14. An equipment carrying mechanism of the class illustrated for selectively securing a first, second or third class of equipment, or any combination thereof, and including base means supporting first, second and third retention units for respectively receiving first, second and third class of equipment into cooperable engagement therewith, said first retention unit adapted for incremental adjustment relative to said base means, said second retention unit movable mounted onto said base means, said third retention units disposed integral with said second retention unit and substantially coextensive therewith, manipulatable securing means communicating between first retention means and said base means and rotatably supported interiorly at the upper terminus of said base means, the consequential operation of said cooperable retention units together with said securing means all relative to said base means according to a predetermined relationship for assembling said equipment such as skis, poles and boots, or the like, into releasable securement therewith.

* * * * *